United States Patent [19]

Kobayashi et al.

[11] Patent Number: 4,562,819

[45] Date of Patent: Jan. 7, 1986

[54] METHOD AND APPARATUS FOR CONTROLLING FUEL SUPPLY OF AN INTERNAL COMBUSTION ENGINE

[75] Inventors: Nobuyuki Kobayashi, Toyota; Toshiaki Isobe, Nagoya, both of Japan

[73] Assignee: Toyota Jidosha Kabushiki Kaisha, Toyota, Japan

[21] Appl. No.: 479,133

[22] Filed: Mar. 25, 1983

[30] Foreign Application Priority Data

Mar. 27, 1982 [JP] Japan ..... 57-048114
Mar. 27, 1982 [JP] Japan ..... 57-048118

[51] Int. Cl.[4] ..... F02D 5/02
[52] U.S. Cl. ..... 123/491; 123/179 G
[58] Field of Search ..... 123/179 G, 179 L, 480, 123/486, 491

[56] References Cited

U.S. PATENT DOCUMENTS 4,436,073 3/1984 Miyagi ..... 123/491
4,438,748 3/1984 Ikeura et al. ..... 123/491

FOREIGN PATENT DOCUMENTS 0019962 2/1980 Japan ..... 123/491
0049538 4/1980 Japan ..... 123/491

*Primary Examiner*—Tony M. Argenbright
*Assistant Examiner*—W. R. Wolfe
*Attorney, Agent, or Firm*—Cushman, Darby & Cushman

[57] ABSTRACT

Fuel supply to an internal combustion engine is controlled in accordance with the operating condition of the engine. Enrichment operation after the starting of the engine is executed for a period of from the start of the engine until the actual engine temperature becomes higher than the engine temperature at the start thereof by a predetermined value.

28 Claims, 11 Drawing Figures

METHOD AND APPARATUS FOR CONTROLLING FUEL SUPPLY OF AN INTERNAL COMBUSTION ENGINE

BACKGROUND OF THE INVENTION

1. Field of the Invention

The present invention relates to a method and apparatus for controlling the fuel supply of an internal combustion engine in response to engine operating parameters.

2. Description of the Prior Art

In one known fuel supply control method, the engine running speed and the intake manifold pneumatic pressure are detected, and then used to calculate the basic pulse width of an injection signal to be applied to the fuel injectors. This basic pulse width is corrected in accordance with the engine temperature such as the coolant temperature. The corrected injection pulse width is used to adjust the actual fuel supply.

It is accepted practice to correct the increment of injection pulse width (correction of warming-up increment) depending upon the engine temperature in order to improve the operating performance of the engine when it is cold. Immediately after the engine starts to run, however, such a correction of warming-up increment is not sufficient; i.e., more of an increment of fuel is necessary for obtaining stabilized operation of the engine immediately after the engine is started. Namely, immediately after starting, the lubricating oil is so cold that the lubricating function is not fully exhibited. Furthermore, the wall temperature of the combustion chamber is so low that the gas does not completely burn. In order to stably run the engine therefore, a correction of fuel increment after starting, which increases fuel more than during warming-up is necessary. According to the conventional fuel supply control method, the amount of fuel supply is increased for a fixed period of time after engine starting. According to such a conventional method, therefore, the amount of fuel supplied after engine starting cannot be controlled to an ideal increment or an ideal period of increment required for the engine. When the engine condition changes to a heavy-load condition immediately after starting, the engine temperature rises quickly, and thus the amount of fuel supplied need be increased for a short period of time after starting. When the engine is maintained under the idling condition after starting, on the other hand, since the engine temperature rises slowly, the amount of fuel supplied should be increased for an extended period of time after starting.

Furthermore, if the above-mentioned fuel increment after starting is always carried out after the engine starts, an air-fuel ratio of mixture supplied to the engine sometimes becomes too rich with respect to a stoichiometric condition. There is no problem when the engine starts from the cold condition. However, in the case that the engine is started again after being warmed-up, if the fuel increment after starting is carried out, the air-fuel ratio is extremely enriched causing the exhaust emission characteristics to extremely deteriorate and causing fuel consumption to unefficiently increase.

SUMMARY OF THE INVENTION

It is therefore an object of the present invention to provide a method and apparatus for controlling the fuel supply of an internal combustion engine, whereby an optimum amount of fuel increment can be supplied to the engine after starting.

Another object of the present invention is to provide a fuel supply control method and apparatus, whereby the air-fuel ratio is not too enriched even when the engine is started again after being warmed-up.

The above objects are achieved by a method of controlling the fuel supply of an internal combustion engine comprising the steps of: detecting whether the engine starts or not to produce a first electrical signal which indicates the detected result; detecting, in response to the first electrical signal, an engine temperature when the engine starts to produce a second electrical signal which indicates the detected engine temperature at the start of the engine; detecting an actual engine temperature after the engine starts to produce a third electrical signal which indicates the detected actual engine temperature after the start of the engine; detecting engine operating conditions to produce a fourth electrical signal which indicates the detected operating condition; calculating, in response to the fourth electrical signal, a value which corresponds to a basic fuel supply to the engine; correcting, in response to the first, second, and third electrical signals, to increase the calculated value for the fuel supply by an increment value during a period of from the start of the engine until the engine temperature, after engine starting, exceeds the engine temperature at the start of the engine by a first predetermined temperature; and adjusting, in accordance with the value for the fuel supply, the actual fuel supply to the engine.

The above objects will be also achieved by a method of controlling the fuel supply of an internal combustion engine comprising the steps of: detecting whether the engine starts or not to produce a first electrical signal which indicates the detected result; detecting, in response to the first electrical signal, an engine temperature when the engine starts to produce a second electrical signal which indicates the detected engine temperature at the start of the engine; detecting an actual engine temperature after the engine starts to produce a third electrical signal which indicates the detected actual engine temperature after the start of the engine; detecting engine operating conditions to produce a fourth electrical signal which indicates the detected operating condition; detecting, in response to the third electrical signal, whether or not the actual engine temperature is higher than a second predetermined temperature to produce a sixth electrical signal which indicates the detected result; calculating, in response to the fourth electrical signal, a value which corresponds to a basic fuel supply to the engine; correcting, in response to the first, second, third, and sixth electrical signals, to increase the calculated value for the fuel supply by an increment value during a period of from the start of the engine until the engine temperature, after engine starting, exceeds the engine temperature at the start of the engine by a first predetermined temperature, the above correcting being executed only when the actual engine temperature is not higher than the second predetermined temperature; and adjusting, in accordance with the value for the fuel supply, the actual fuel supply to the engine.

Furthermore, the above objects will be achieved by an apparatus for controlling fuel supply of an internal combustion engine comprising: means for detecting whether the engine starts or not to produce a first electrical signal which indicates the detected result; means for detecting, in response to the first electrical signal, an engine temperature when the engine starts to produce a second electrical signal which indicates the detected engine temperature at the start of the engine; means for detecting an actual engine temperature after the engine starts to produce a third electrical signal which indicates the detected actual engine temperature after the start of the engine; means for detecting engine operating conditions to produce a fourth electrical signal which indicates the detected operating condition; processing means for (1) calculating, in response to the fourth electrical signal, a value which corresponds to a basic fuel supply to the engine, and (2) correcting, in response to the first, second, and third electrical signals, to increase the calculated value for the fuel supply by an increment value during a period of from the start of the engine until the engine temperature, after engine starting, exceeds the engine temperature at the start of the engine by a first predetermined temperature; and means for adjusting, in accordance with the value for the fuel supply, the actual fuel supply to the engine.

The above objects will be also achieved by an apparatus for controlling the fuel supply of an internal combustion engine comprising: means for detecting whether the engine starts or not to produce a first electrical signal which indicates the detected result; means for detecting, in response to the first electrical signal, an engine temperature when the engine starts to produce a second electrical signal which indicates the detected engine temperature at the start of the engine; means for detecting an actual engine temperature after the engine starts to produce a third electrical signal which indicates the detected actual engine temperature after the start of the engine; means for detecting engine operating conditions to produce a fourth electrical signal which indicates the detected operating condition; means for detecting, in response to the third electrical signal, whether or not the actual engine temperature is higher than a second predetermined temperature to produce a sixth electrical signal which indicates the detected result; processing means for (1) calculating, in response to the fourth electrical signal, a value which corresponds to a basic fuel supply to the engine, and (2) correcting, in response to the first, second, third, and sixth electrical signals, to increase the calculated value for the fuel supply by an increment value during a period of from the start of the engine until the engine temperature, after engine starting, exceeds the engine temperature at the start of the engine by a first predetermined temperature, the above correcting being executed only when the actual engine temperature is not higher than the second predetermined temperature; and means for adjusting, in accordance with the value for the fuel supply, the actual fuel supply to the engine.

The above and other related objects and features of the present invention will be apparent from the description of the present invention set forth below, with reference to the accompanying drawings, as well as from the appended claims.

DESCRIPTION OF THE PREFERRED EMBODIMENTS

Figure 1:
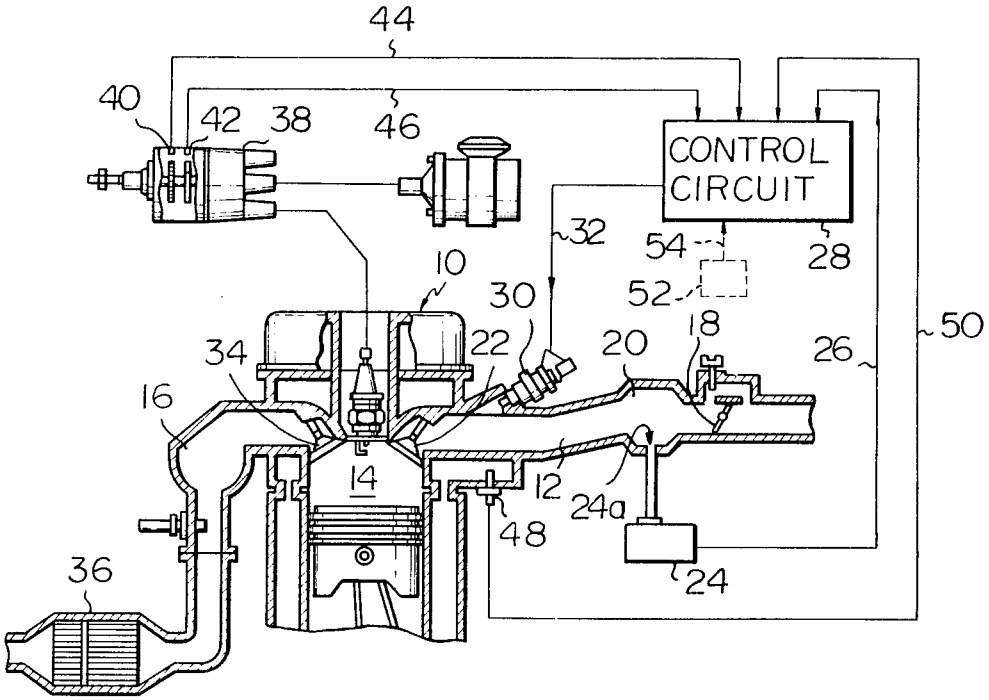
FIG. 1 is a schematic diagram of an electronic fuel injection control system of an internal combustion engine according to the present invention.

In FIG. 1, reference numeral 10 denotes an engine body, 12 an intake passage, 14 a combustion chamber, and 16 an exhaust passage. The flow rate of intake air introduced through an air cleaner (not shown) is controlled by a throttle valve 18 interlocked with an accelerator pedal (not shown). The intake air passing through the throttle valve 18 is introduced into the combustion chamber 14 via a surge tank 20 and an intake valve 22.

In the intake passage 12, at a position downstream of the throttle valve 18, for example, at a position of the surge tank 20, a pressure take-out port **24*a* is opened. The pressure take-out port 24*a* is connected with a pneumatic pressure snesor 24 which detects the absolute pneumatic pressure in the intake manifold and produces a voltage corresponding to the detected pressure. The output voltage from the pneumatic pressure sensor 24 is fed to a control circuit 28 via a line 26**.

Each of fuel injectors 30 for the cylinders is opened and closed in response to electrical drive pulses fed from the control circuit 28 via a line 32. The fuel injectors 30 intermittently inject into the intake passage 12 compressed fuel from a fuel supply system (not shown) in the vicinity of the intake valve 22.

The exhaust gas produced due to combustion in the combustion chamber 14 is emitted into the atmosphere via an exhaust valve 34, the exhaust passage 16, and catalytic converter 36.

Crank angle sensors 40 and 42 disposed in a distributor 38 produce pulse signals at every crank angle of 30° and 360°, respectively. The pulse signals produced at every 30° crank angle are fed to the control circuit 28 via a line 44. The pulse signals produced at every 360° crank angle are fed to the control circuit 28 via a line 46.

A coolant temperature sensor 48 mounted on the cylinder block of the engine produces a voltage which corresponds to a coolant temperature. The output voltage from the coolant temperature sensor 48 is fed to the control circuit 28 via a line 50.

A starter signal from a starter switch 52 may be fed to the control circuit 28 via a line 54. The starter signal may be utilized in an embodiment described hereinafter.

Figure 2:
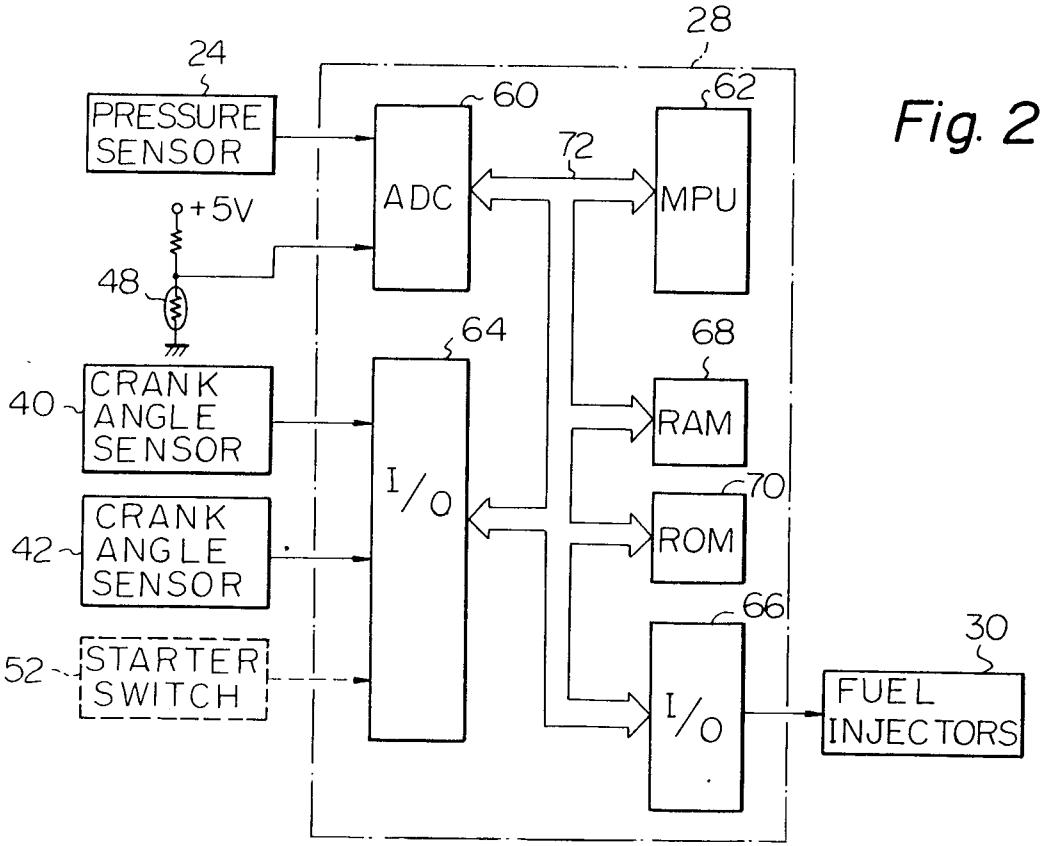
FIG. 2 is a block diagram of a control circuit shown in FIG. 1.

FIG. 2 illustrates an example of the control circuit 28 of FIG. 1. In FIG. 2, the pneumatic pressure sensor 24, crank angle sensors 40 and 42, starter switch 52, and fuel injectors 30 are represented by blocks.

The coolant temperature sensor 48 consists of a thermistor as shown in FIG. 2, and a series circuit consisting of the thermistor and a fixed resistor is inserted across a constant-voltage supply and ground. Output voltage of the coolant temperature sensor 48 is taken out from a terminal on the ungrounded side of the thermistor.

The output voltages from the pneumatic pressure sensor 24 and coolant temperature sensor 48 are applied to an analog-to-digital (A/D) converter 60 which contains an analog multiplexer and A/D converter and are sequentially converted into signals in the form of binary numbers in response to instructions from a microprocessor unit (MPU) 62.

The pulse signals produced by the crank angle sensor 40 every 30° crank angle are fed to the MPU 62 via an input-output (I/O) circuit 64 as interrupt-request signals for the interruption routine of every 30° crank angle. The pulse signals from the crank angle sensor 40 are further supplied to a timing counter disposed in the I/O circuit 64 as counting pulses. The pulse signals produced by the crank angle sensor 42 every 360° crank angle are used as reset pulses of the above timing counter. The timing counter produces fuel-injection initiation pulses which are fed to the MPU 62 as interrupt-request signals for the injection interruption routine.

A starter signal of one bit having a level of "1" or "0" may be fed from the starter switch 52 to the I/O circuit 64.

In an I/O circuit 66, a drive circuit which receives a one bit injection pulse having a pulse width TAU calculated by the MPU 62 and converts the injection pulse into a drive signal is provided. The drive signal from the drive circuit is fed to the fuel injectors 30 to inject into the engine a quantity of fuel corresponding to the pulse width TAU.

The A/D converter 60 and I/O circuits 64 and 66 are connected via a bus 72 to the MPU 62, a random acces memory (RAM) 68, and a read only memory (ROM) 70, which constitute the microcomputer. The data are transferred via the bus 72.

In the ROM 70 are stored beforehand a routine program for main processing, a crank angle interrupt-processing program, another routine program, and various types of data or tables which are necessary for carrying out arithmetic calculations.

Hereinafter, the operation of the microcomputer will be illustrated with reference to the flow diagrams of FIGS. 3, and 4.

Figure 3:
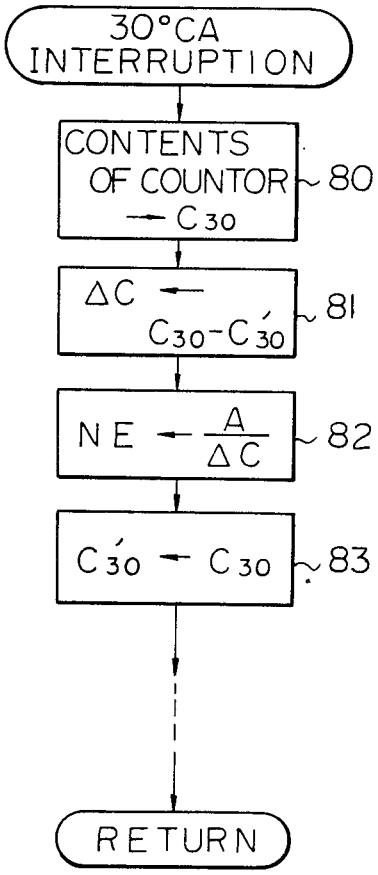
FIGS. 3 and 4 are flow diagrams of parts of the control programs of a microcomputer in the control circuit of FIG. 2.

When a pulse signal at every 30° crank angle is applied from the crank angle sensor 40, the MPU 62 executes the interrupt-processing routine shown in FIG. 3 for producing rpm data which indicates the running speed NE of the engine.

At a point 80, the contents of a free-run counter provided in the MPU 62 are read out and temporarily stored in a register in the MPU 62 as $C_{30}$. At a point 81, the difference $\Delta C$ between contents $C_{30}$ of the free-run counter which are read out in the present interruption process and contents $C_{30}'$ of the free-run counter, which contents were read out in the last interruption process is calculated from $\Delta C = C_{30} - C_{30}'$. Then, at a point 82, the reciprocal of the difference C is calculated to obtain the running speed NE. Namely, at the point 82, calculation of $NE = A/\Delta C$ is executed, where A is a constant. The calculated NE is stored in the RAM 68. At a point 83, contents $C_{30}$ in the present interruption process are stored in the RAM 68 as contents $C_{30}'$ of the free-run counter in the last interruption process and are used in the next interruption process. Thereafter, another process is executed in the interrupt-processing routine and then the program returns to the main processing routine.

The MPU 62 further introduces binary signals which correspond to the output voltages of the pneumatic pressure sensor 24 and the coolant temperature sensor 48 from the A/D converter 60 in response to the interrupt request which occurs at every completion of A/D conversion. Then, the MPU 62 stores the introduced binary signals in the RAM 68.

Figure 4:
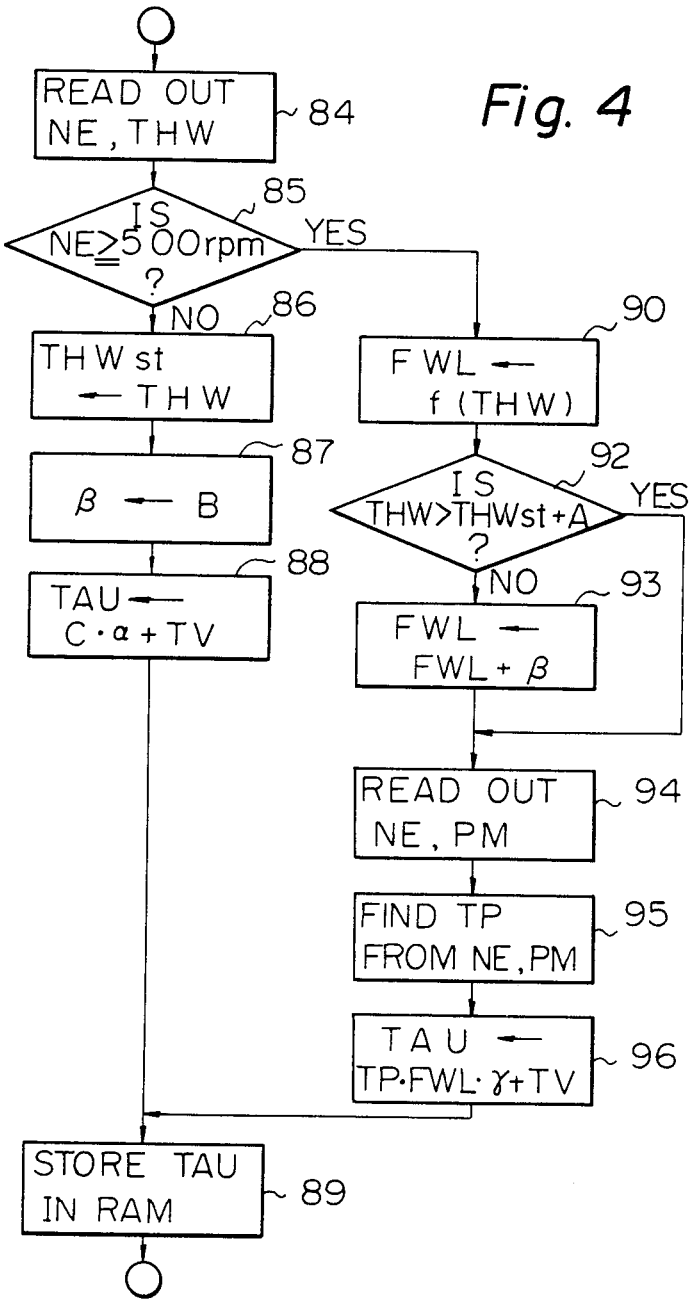

The MPU 62, on the other hand, executes the processing of FIG. 4 during the main processing routine. First, the data related to the engine running speed NE and the coolant temperature THW are read out at a point 84 from the RAM 68. A next point 85 checks whether the engine running speed NE is greater than 500 rpm, thereby to determine whether the engine starts to run or not. When the result is "NO", namely, when the running speed NE is smaller than 500 rpm, the engine is being started, and the program proceeds to a point 86. At the point 86, the coolant temperature THW at this moment is stored as THWst. At a point 87, an additional increment $\beta$ that will be used at a point 93 as will be mentioned later is equalized to a constant B. At a point 88, a basic injection pulse width C which is maintained constant, is multiplied by a correction coefficient $\alpha$ determined by the coolant temperature and the like, and to the product thereof a dead injection pulse width TV of the fuel injector is added to form a final fuel injection pulse width TAU. Namely, the point 88 executes the calculation of $TAU \leftarrow C \cdot \alpha + TV$. Thus, when the engine is starting, the basic injection pulse width TAU is maintained constant irrespective of the intake manifold pressure PM and the engine running speed NE. A binary data which represents the calculated pulse width TAU is stored in a predetermined position in the RAM 68 at a next point 89. When the engine running speed NE is less than 500 rpm, the above-mentioned processing is executed repetitively, and the newest coolant temperature THW is stored as THWst during engine starting.

Figure 5:
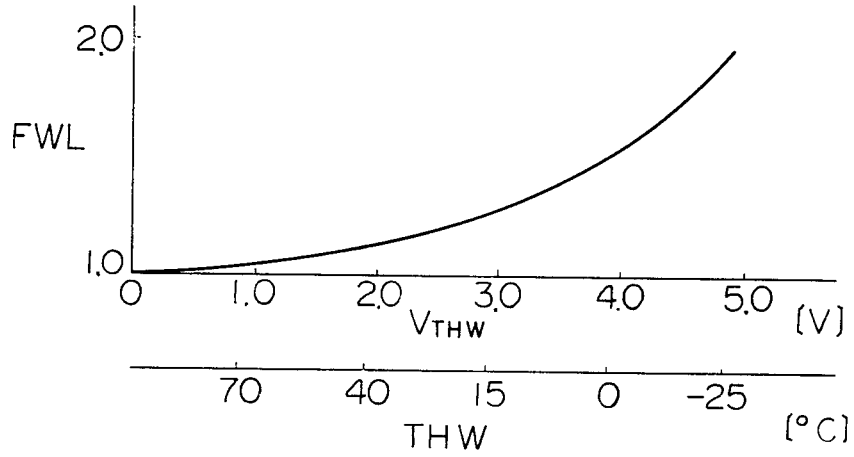
FIG. 5 is a graph of the relation between coolant temperature THW and warming-up increment coefficient FWL.

As the engine running speed NE becomes equal to or greater than 500 rpm, i.e., after the engine starts to run, the program proceeds from the point 85 to a point 90 where the processing is executed to find an increment coefficient FWL for warming-up from the input data that represents the coolant temperature THW. The warming-up increment coefficient FWL is stored in the ROM 70 as a function f (THW) of the coolant temperature THW in the form of a function table. In the embodiment of the present invention, in particular, the function table of FWL is formed maintaining an equal interval relative to the values which are obtained by subjecting output voltages of the coolant temperature sensor 48 to the A/D conversion. That is, as shown in FIG. 5, an equal interval is maintained relative to output voltage $V_{THW}$ of the coolant temperature sensor 48 but not relative to the coolant temperature THW. By so forming the function table of THW-FWL, a numerical formula for performing the interpolation can be simplified. Thus, the function table of the warming-up increment coefficient FWL can be processed very easily, making it possible to reduce the number of steps of the program.

A point 92 determines whether or not the present coolant temperature THW has exceeded a temperature THWst + A, which is higher than THWst by a predetermined fixed temperature A (determined to a fixed value from 2° C. to 10° C.). As mentioned earlier, THWst is renewed to the coolant temperature THW every time when the main processing routine is executed while starting of the engine. After starting, the above renewal is not executed. Therefore, THWst maintains a value nearly equal to the coolant temperature of when the engine is started. Namely, the point 92 determines whether or not the coolant temperature THW has risen by more than a predetermined fixed value A over the coolant temperature of just when the engine is started. When the result is "NO", the program proceeds to a point 93 where the warming-up increment coefficient FWL found in the point 90 is increased by the additional increment $\beta$. This operation corresponds to an enrichment operation after staring. The program then proceeds to a point 94. On the other hand, when the result is determined to be "YES" in the point 92, i.e., when the coolant temperature THW has risen to a value which is higher than the temperature of just when the engine is started by more than a predetermined fixed value A, the program proceeds to a point 94 without adding the additional increment $\beta$ to the increment coefficient FWL.

The point 94 reads out the data related to the running speed NE and the intake manifold pressure PM from the RAM 68. At a point 95, a basic injection pulse width TP is found from a function table depending upon the running speed NE and the intake manifold pressure PM by using interpolation. In the ROM 70 has been stored a quadratic function table indicating a relationship between basic injection pulse widths TP (msec), the running speeds NE, and the intake manifold pressures PM as tabulated below.

| NE<br>PM | 500 | 1000 | 2000 | 3000 | 4000 | 5000 | 6000 |
|---|---|---|---|---|---|---|---|
| 200 | 1.50 | 1.55 | 1.60 | 1.65 | 1.70 | 1.65 | 1.60 |
| 300 | 2.30 | 2.35 | 2.40 | 2.45 | 2.50 | 2.45 | 2.40 |
| 400 | 3.10 | 3.15 | 3.20 | 3.25 | 3.30 | 3.25 | 3.20 |
| 500 | 3.80 | 3.85 | 3.90 | 3.95 | 4.00 | 3.95 | 3.90 |
| 600 | 4.55 | 4.60 | 4.65 | 4.70 | 4.75 | 4.70 | 4.65 |
| 700 | 5.30 | 5.35 | 5.40 | 5.45 | 5.50 | 5.45 | 5.40 |
| 800 | 6.05 | 6.10 | 6.15 | 6.20 | 6.25 | 6.20 | 6.15 |

NE (rpm), PM (mmHg abs)

Then, at a point 96, a final fuel injection pulse width TAU is calculated from the basic injection pulse width, the warming-up increment coefficient FWL, other correction coefficients, and the dead injection pulse width TV of the fuel injectors 30, according to the following equation.

$$TAU = TP\ FWL \cdot \gamma + TV$$

Then, at the point 89, the binary data which represents the calculated pulse width TAU is stored in the RAM 68, and the arithmetic calculation for finding the injection pulse width is completed in the main processing routine.

There are various methods for producing an injection signal having a duration corresponding to the calculated pulse width TAU. One method is as follows. First, the injection signal is inverted from "0" to "1" and the contents of the free-run counter are read out when a fuel-injection initiation pulse is produced. By using the read out contents, a value corresponding to contents of the free run counter after the time of TAU has elapsed from the development of the fuel-injection initiation pulse is calculated. The calculated value is set to a compare register. When the contents of the free-run counter become equal to the contents in the compare register, an interrupt-request signal is produced to invert the injection signal from "1" to "0". Accordingly, an injection signal having a duration which corresponds to TAU is formed. The above fuel-injection initiation pulse is produced each time the interrupt-processing routine of 30° crank angle shown in FIG. 3 is executed several times.

Below the functions and effects of the above-mentioned embodiments are described. According to the embodiment as indicated by a solid line in FIG. 6, the warming-up increment coefficient FWL is increased by a predetermined fixed value B from the moment when the engine starts to run. Therefore, the amount of fuel supplied to the engine is increased correspondingly. The increment of fuel supply is maintained until the coolant temperature THW rises by a predetermined fixed temperature A over the temperature of when the engine starts. The increment of fuel supply is no more maintained after the coolant temperature THW has risen by the predetermined fixed temperature A. According to this embodiment as described above, the amount of supplying fuel is increased just when the engine is started until when the coolant temperature rises by a predetermined fixed temperature over the temperature of when the engine starts. Therefore, irrespective of the operating condition after the engine is started, the amount of supplying fuel can be increased in an optimum manner to meet the rise of the engine temperature.

The processing routine of FIG. 4 determines whether the engine starts to run or not relying upon whether the engine running speed NE is greater than 500 rpm or not. This, however, may be determined relying upon the starter signal from the starter switch 52. That is, processings of points 100 and 101 illustrated in FIG. 7 may be carried out instead of the points 84 and 85 of FIG. 4. THe point 100 reads out the data of coolant temperature THW only, and the point 101 determines whether the starter switch 52 is turned off or not relying upon the starter signal. When the result is "NO",the program proceeds to the point 86. When the result is "YES", the program proceeds to the point 90.

Figure 6:
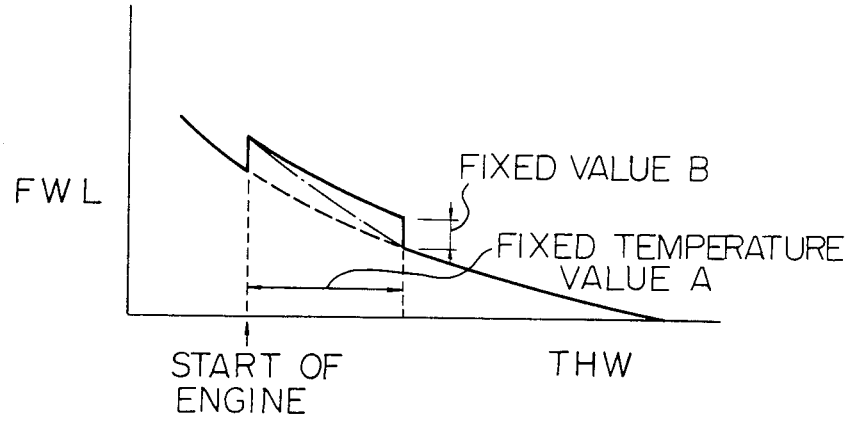
FIG. 6 is a graph of the relation between coolant temperature THW and increased warming-up increment coefficient FWL.

In the above-mentioned embodiment, furthermore, the additional increment $\beta$ is maintained at a constant value B at all times. The additional increment $\beta$, however, may be gradually decreased with the lapse of time after the start of the engine or with the increase in accordance with the total number of revolutions of the engine after the start of the engine. That is, as illustrated in a point 102 of FIG. 8, if the additional increment $\beta$ is decreased by a predetermined value D during a time interrupt processing routine which is executed at every predetermined period of time, the additional increment $\beta$ gradually decreases with the lapse of time after the start of the engine. Further, as illustrated in a point 103 of FIG. 9, if the additional increment $\beta$ is decreased by a predetermined value E during an angle interrupt processing routine which is executed at every predetermined crank angle of the engine, the additional increment 62 gradually decreases with the increase in accordance with the total number of revolutions of the engine. Moreover, if the additional increment $\beta$ is determined from a relation $\beta \leftarrow B - F \cdot (THW - THWst)$ during the time interrupt processing routine or the angle interrupt processing routine, as illustrated in a point 104 of FIG. 10, the additional increment $\beta$ can be gradually decreased in accordance with the difference between the actual coolant temperature THW and the coolant temperature at the start of the engine. In the above relation, F is a constant. A chain line of FIG. 6 illustrates the case when the additional increment $\beta$ is gradually decreased with the lapse of time, with the increase in the number of revolutions, or with the rise in the coolant temperature. Thus, the increment of fuel supply gradually decreases and, hence, the transient operating characteristics from the enrichment operation after starting to ordinary operation can be improved, contributing to reducing the consumption of fuel.

In the above-mentioned embodiment, the temperature of the engine is detected relying upon the temperature of the coolant. The temperature of the engine, however, may be detected relying upon the temperature of the lubricating oil or the temperature of the engine block.

According to the above embodiment as described above in detail, the period for increasing the amount of fuel supply is determined depending upon whether the engine temperature has risen by a predetermined fixed temperature over the temperature of just when the engine is started. Therefore, an optimum amount of fuel supply can be realized after the engine is started to meet the actual temperature rise of the engine. Consequently, operating charcteristics of the engine, characteristics of exhaust emission, and fuel efficiency can be improved.

Figure 7:
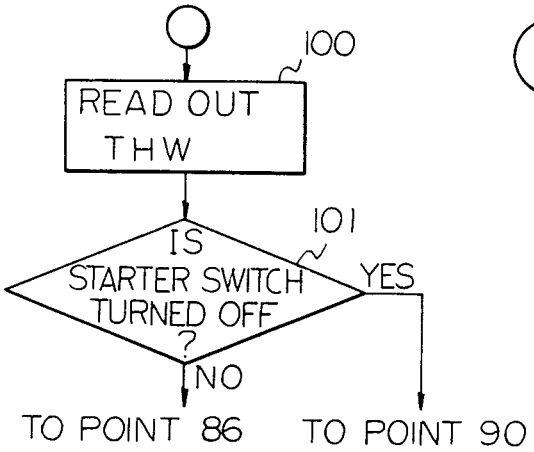
FIGS. 7 to 11 are flow diagrams of parts of the control programs of a microcomputer in the control circuit of FIG. 2.
Figure 8:
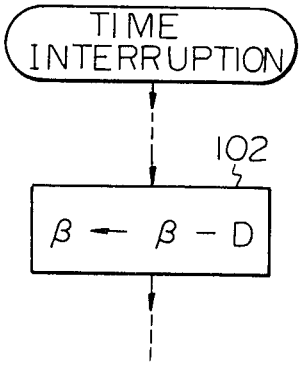
Figure 9:
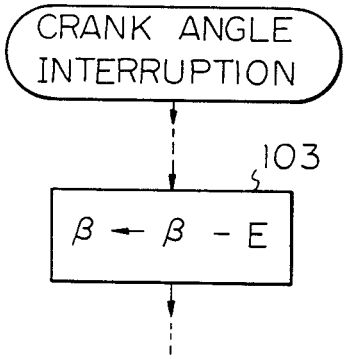
Figure 10:
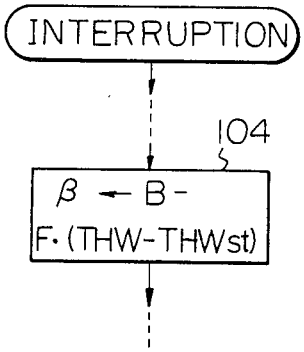
Figure 11:
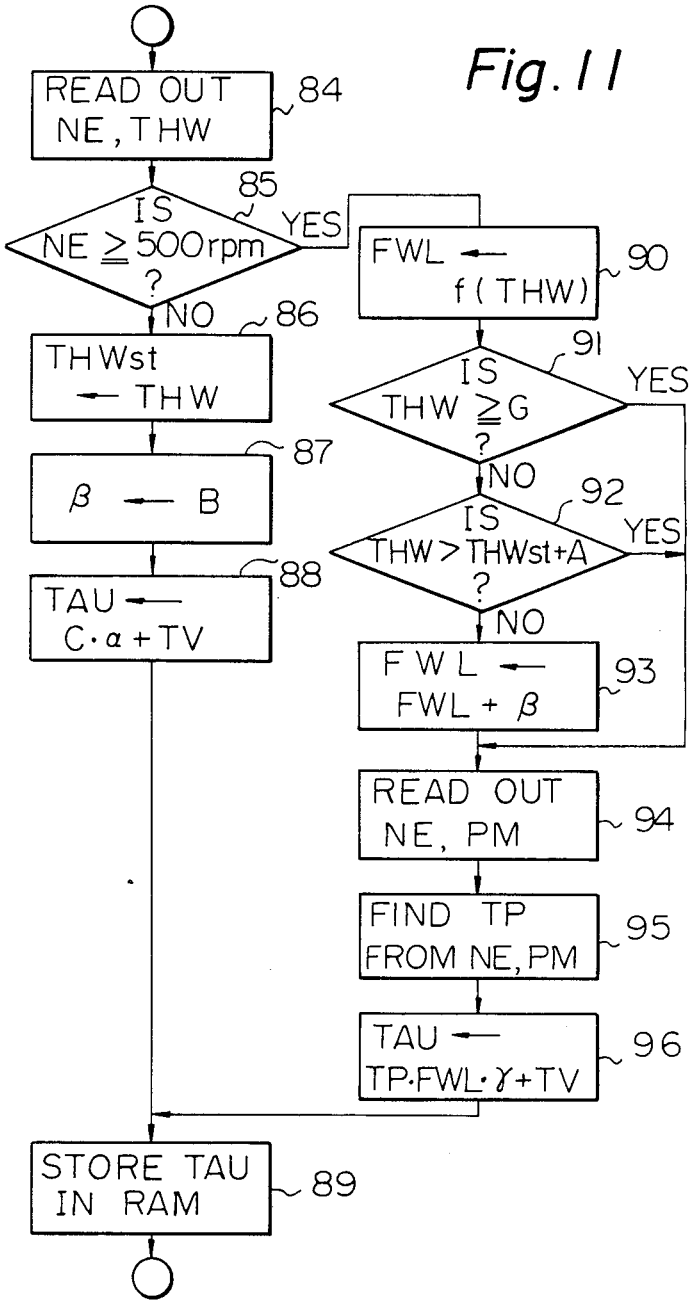

During the main processing routine the MPU 62 may execute the processing of FIG. 11 instead of the processing of FIG. 4. In the processing of FIG. 11, an additional step of a point 91 is inserted between the points 90 and 92. Other steps of this processing are the same as those of the processing of FIG. 4. The point 91 determines whether or not the actual coolant temperature THW is equal to or greater than a predetermined temperature G, for example, which is determined from about 60° C. to 70° C. If it is THW$\geqq$G, the engine has already been fully warmed-up and the program proceeds to the point 94 without executing the enrichment operation after starting in the points 92 and 93. On the other hand, if THW$<$G, since the engine is cold, the program proceeds to the point 92. Therefore, according to the processing of FIG. 11, the enrichment operation after starting in the points 92 and 93 is not executed when the engine is started again after the engine is warmed-up. Accordingly, the air-fuel mixture is not too enriched causing the exhaust emission characteristics to improve and causing fuel consumption to efficiently decrease. In the above-mentioned processing of FIG. 11, the start of the engine can be determined by the starter signal from the starter switch 52 as shown in FIG. 7. Furthermore, the additional increment $\beta$ is decreased as shown in FIGS. 8 to 10.

As many widely different embodiments of the present invention may be constructed without departing from the spirit and scope of the present invention, it should be understood that the present invention is not limited to the specific embodiments described in this specification, except as defined in the appended claims.

We claim:

1. A method of controlling fuel supply of an internal combustion engine comprising the steps of:

detecting whether said engine starts or not to produce a first electrical signal which indicates the detected result;

detecting, in response to said first electrical signal, an engine temperature when said engine starts;

detecting an actual engine temperature after said engine starts;

detecting an engine operating condition to produce a second electrical signal which indicates the detected operating condition;

calculating, in response to said second electrical signal, a value which corresponds to a basic fuel supply to said engine;

calculating a warming-up increment coefficient according to said detected actual engine temperature after the start of said engine;

correcting said warming-up increment coefficient, in response to said first electrical signal, said detected engine temperature at the start of said engine and said detected actual engine temperature after the start of said engine, to increase by an increment value during a period from the start of said engine to the time that said detected actual engine temperature after the start of said engine exceeds said detected temperature at the start of said engine by a first predetermined temperature; and adjusting, in accordance with the value for the fuel supply and said corrected warming-up increment coefficient, an actual fuel supply to said engine.

2. A method as claimed in claim 1, wherein said increment value is a fixed value.

3. A method as claimed in claim 1, wherein said increment value is decreased with the lapse of time from the start of the engine.

4. A method as claimed in claim 1, wherein said increment value is decreased in accordance with the number of revolutions of the engine from the start of the engine.

5. A method as claimed in claim 1, wherein said increment value is decreased in accordance with the difference between said actual engine temperature and said engine temperature at the start of said engine.

6. A method as claimed in claim 1, wherein said step of detecting whether said engine starts or not includes the steps of:

detecting an engine running speed to produce a third electrical signal which indicates the detected engine running speed; and detecting, in response to the third electrical signal, whether or not the detected engine running speed exceeds a predetermined speed to produce said first electrical signal.

7. A method as claimed in claim 1, wherein said step of detecting whether the engine starts or not includes a step of detecting whether a starter switch of said engine is turned on or not to produce said first electrical signal.

8. A method of controlling fuel supply of an internal combustion engine comprising the steps of:

detecting whether said engine starts or not to produce a first electrical signal which indicates the detected result;

detecting, in response to said first electrical signal, an engine temperature when said engine starts;

detecting an actual engine temperature after said engine starts;

detecting an engine operating condition to produce a second electrical signal which indicates the detected operating condition;

detecting whether or not said actual engine temperature is higher than a second predetermined temperature to produce the detected result;

calculating, in response to said second electrical signal, a value which corresponds to a basic fuel supply to said engine;

calculating a warming-up increment coefficient according to said detected actual engine temperature after the start of said engine;

correcting said warming-up increment coefficient, in response to said first electrical signal, said detected engine temperature at the start of said engine and said detected actual engine temperature after the start of said engine, to increase by an increment value during a period from the start of said engine to the time that said detected actual engine temperature after the start of said engine exceeds said detected engine temperature at the start of said engine by a first predetermined temperature, said correcting being executed only when said actual engine temperature is equal to or lower than said second predetermined temperature; and adjusting, in accordance with the value for the fuel supply and said corrected warming-up increment coefficient, an actual fuel supply to said engine.

9. A method as claimed in claim 8, wherein said increment value is a fixed value.

10. A method as claimed in claim 8, wherein said increment value is decreased with the lapse of time from the start of said engine.

11. A method as claimed in claim 8, wherein said increment value is decreased in accordance with the number of revolutions of said engine from the start of said engine.

12. A method as claimed in claim 8, wherein said increment value is decreased in accordance with the difference between said actual engine temperature and said engine.

13. A method as claimed in claim 8, wherein said step of detecting whether said engine starts or not includes the steps of:

detecting an engine running speed to produce a third electrical signal which indicates the detected engine running speed; and detecting, in response to said third electrical signal, whether or not the detected engine running speed exceeds a predetermined speed to produce said first electrical signal.

14. A method as claimed in claim 8, wherein said step of detecting whether the engine starts or not includes a step of detecting whether a starter switch of said engine is turned on or not to produce said first electrical signal.

15. An apparatus for controlling the fuel supply of an internal combustion engine comprising:

means for detecting whether said engine starts or not to produce a first electrical signal which indicates the detected result;

means for detecting, in response to said first electrical signal, an engine temperature when said engine starts;

means for detecting an actual engine temperature after said engine starts;

means for detecting an engine operating condition to produce a second electrical signal which indicates the detected operating condition;

means for calculating, in response to said second electrical signal, a value which corresponds to a basic fuel supply to said engine;

means for calculating a warming-up increment coefficient according to said detected actual engine temperature after the start of said engine;

means for correcting said warming-up increment coefficient, in response to said first electrical signal, said detected engine temperature at the start of said engine and said detected actual engine temperature after the start of said engine, to increase by an increment value during a period from the start of said engine to the time that said detected actual engine temperature after the start of said engine exceeds said detected engine temperature at the start of said engine by a first predetermined temperature; and means for adjusting, in accordance with the value for the fuel supply and said corrected warming-up increment coefficient, an actual fuel supply to said engine.

16. An apparatus as claimed in claim 15, wherein said increment value is a fixed value.

17. An apparatus as claimed in claim 15, wherein said incrment value is decreased with the lapse of time from the start of the engine.

18. An apparatus as claimed in claim 15, wherein said increment value is decreased in accordance with the number of revolutions of the engine from the start of said engine.

19. An apparatus as claimed in claim 15, wherein said increment value is decreased in accordance with the difference between the actual engine temperature and the engine temperature at the start of the engine.

20. An apparatus as claimed in claim 15, wherein said means for detecting whether said engine starts or not includes:

means for detecting an engine running speed to produce a third electrical signal which indicates the detected engine running speed; and means for detecting, in response to said third electrical signal, whether or not the detected engine running speed exceeds a predetermined speed to produce said first electrical signal.

21. An apparatus as claimed in claim 15, wherein said means for detecting whether said engine starts or not includes a means for detecting whether a starter switch of said engine is turned on or not to produce said first electrical signal.

22. An apparatus for controlling the fuel supply of an internal combustion engine comprising:

means for detecting whether said engine starts or not to produce a first electrical signal which indicates the detected result;

means for detecting, in response to said first electrical signal, an engine temperature when said engine starts to detect the engine temperature at the start of said engine;

means for detecting an actual engine temperature after said engine starts to detect the actual engine temperature after the start of said engine;

means for detecting an engine operating condition to produce a second electrical signal which indicates the detected operating condition;

means for detecting, in response to the third electrical signal, whether or not the actual engine temperature is higher than a second predetermined temperature to produce a fourth electrical signal which indicates the detected result;

means for calculating, in response to said second electrical signal, a value of which corresponds to a basic fuel supply to said engine;

means for calculating a warming-up increment coefficient according to said detected actual engine temperature after the start of said engine;

means for correcting said warming-up increment coefficient, in response to said first electrical signal, said detected engine temperature at the start of said engine and said detected actual engine temperature after the start of said engine, to increase by an increment value during a period from the start of said engine to the time that said detected actual engine temperature after the start of said engine exceeds said detected engine temperature at the start of said engine by a first predetermined temperature, said correcting being executed only when said actual engine temperature is equal to or lower than said second predetermined temperature; and means for adjusting, in accordance with the value for the fuel supply and said corrected warming-up increment coefficient, an actual fuel supply to said engine.

23. An apparatus as claimed in claim 22, wherein said increment value is a fixed value.

24. An apparatus as claimed in claim 22, wherein said increment value is decreased with the lapse of time from the start of said engine.

25. An apparatus as claimed in claim 22, wherein said increment value is decreased in accordance with the number of the revolutions of said engine from the start of said engine.

26. An apparatus as claimed in claim 22, wherein said increment value is decreased in accordance with the difference between said actual engine temperature and said engine temperature at the start of said engine.

27. An apparatus as claimed in claim 22, wherein said means for detecting whether said engine starts or not includes:

means for detecting an engine running speed to produce a third electrical signal which indicates the detected engine running speed; and means for detecting, in response to the third electrical signal, whether or not the detected engine running speed exceeds a predetermined speed to produce said first electrical signal.

28. An apparatus as claimed in claim 22, wherein said means for detecting whether the engine starts or not includes a means for detecting whether a starter switch of said engine is turned on or not to produce said first electrical signal.

* * * * *